US006459356B1

(12) United States Patent
Dout et al.

(10) Patent No.: US 6,459,356 B1
(45) Date of Patent: Oct. 1, 2002

(54) SUBMINIATURE TIME DELAY FUSE

(75) Inventors: Jonathon Dout, Snellville; Doyle Dowd; Paul Rossetti, both of Lawrenceville, all of GA (US)

(73) Assignee: Scientific-Atlanta, Inc., Lawrenceville, GA (US)

( * ) Notice: Subject to any disclaimer, the term of this patent is extended or adjusted under 35 U.S.C. 154(b) by 123 days.

(21) Appl. No.: 09/645,202

(22) Filed: Aug. 25, 2000

(51) Int. Cl.[7] ..... H01H 85/175; H01H 85/153

(52) U.S. Cl. ..... 337/198; 337/187; 337/228; 337/229; 361/626

(58) Field of Search ..... 337/163, 186, 337/187, 227, 228, 229, 198; 361/104, 626; 29/623

(56) References Cited

U.S. PATENT DOCUMENTS

| | | | | | |
|---|---|---|---|---|---|
| 4,080,039 | A | * | 3/1978 | Ahroni | 337/197 |
| 4,224,592 | A | | 9/1980 | Urani et al. | |
| 4,504,816 | A | * | 3/1985 | Viola et al. | 337/255 |
| 4,544,907 | A | * | 10/1985 | Takano | 337/262 |
| 4,997,393 | A | * | 3/1991 | Armando | 333/181 |
| 5,629,664 | A | * | 5/1997 | Muramatsu et al. | 337/190 |
| 5,682,130 | A | * | 10/1997 | Styrna et al. | 337/190 |
| 5,854,583 | A | * | 12/1998 | Falchetti | 337/159 |

FOREIGN PATENT DOCUMENTS

| | | | | |
|---|---|---|---|---|
| JP | 56-53 U | * | 1/1981 | H01H/85/00 |
| JP | 57-210537 A | * | 12/1982 | H01H/85/56 |
| JP | 5-205608 A | * | 8/1993 | H01H/85/20 |

OTHER PUBLICATIONS

Product Data Sheet for UL/CSA/ANCE (Mexico) 248–14 vx. IEC 127 Fuse, Littlefuse, Inc.

* cited by examiner

*Primary Examiner*—Anatoly Vortman
(74) *Attorney, Agent, or Firm*—Hubert J. Barnhardt, III; Kenneth M. Massaroni; Shelley L. Couturier

(57) ABSTRACT

A subminiature time delay fuse device (300) that is capable of withstanding higher current ratings includes at least one time delay fuse (310) for receiving a power signal and for providing an open circuit when the power signal is determined to be excessive for a predetermined period of time. The subminiature time delay fuse device (300) has a high-temperature housing (320) that has a plurality of vent holes formed therein, and wherein the housing partially encloses at least one time delay fuse (310). There are two conductive terminals (305) with an upper end for mounting the time delay fuse (310) and a lower end for mating into a socket (235) on an electrical device, such as an amplifier (125).

5 Claims, 4 Drawing Sheets

125

300

SUBMINIATURE TIME DELAY FUSE

FIELD OF THE INVENTION

This invention relates generally to cable television systems and electronic devices used in such systems, and more specifically fuses included in electronic devices.

BACKGROUND OF THE INVENTION

A communication system 100, such as a two-way cable television system, is depicted in FIG. 1. The communication system 100 includes headend equipment 105 for generating forward signals that are transmitted in the forward, or downstream, direction along a communication medium, such as a fiber optic cable 110, to an optical node 115 that converts optical signals to radio frequency (RF) signals. The RF signals are further transmitted along another communication medium, such as coaxial cable 120, and are amplified, as necessary, by one or more distribution amplifiers 125 positioned along the communication medium. Taps 130 included in the cable television system split off portions of the forward signals for provision to subscriber equipment 135, such as set top terminals, computers, and televisions. In a two-way system, the subscriber equipment 135 can also generate reverse signals that are transmitted upstream, amplified by any distribution amplifiers 125, converted to optical signals, and provided to the headend equipment 105.

Network powering devices, such as power supplies, are typically included in many of the devices of the communication system 100 or as separate devices located along the communication medium, such as coaxial cable. The power supplies usually generate both 60 volts alternating current (VAC) and 90VAC power and supply 6 amperes (A) to 15A of current to the powered devices, for example, optical nodes or amplifiers. Power supplies are typically located throughout the communication system 100 near the center of a pocket of amplifiers to maximize the power efficiency. AC power from the power supply enters a power inserter installed on the coaxial cable and combines the AC power with the RF signals. The power inserter then directs the power in both directions along the coaxial cable.

One problem that occurs with some regularity in a communication system 100 is a service outage due to powering faults. Typically, a powering fault may be caused by voltage and current surges or lightning strikes that affect the surrounding devices on the coaxial cable. As a result, there is an increased expectation that devices along the communication medium be designed to adequately prevent service outages, or at the least, protect the devices along the communication medium from failure when powering faults occur within the communication system 100.

Thus, what is needed is a protective device for use in communication devices, such as distribution amplifiers, to provide improved reliability and surge-resistance. Due to development time and the cost of installing new equipment, however, it is also important that a protective device retrofit easily and inexpensively into existing products to keep upgrade costs to a minimum.

DETAILED DESCRIPTION OF A PREFERRED EMBODIMENT

With the broadening of traditional cable service, the newer broadband services that are provided to the subscriber may also include two-way, telephone and/or cable modem services; therefore, it is increasingly more important to the system operators to prevent service outages. The service outages are a result of any number of reasons, but a specific fault pertaining to this invention is a powering fault that occurs within the communication system 100. As a result of the increased attention to service reliability, it is incumbent upon the manufacturers of the communication devices to design a robust product with the required accessories to assist in this endeavor.

Figure 1:
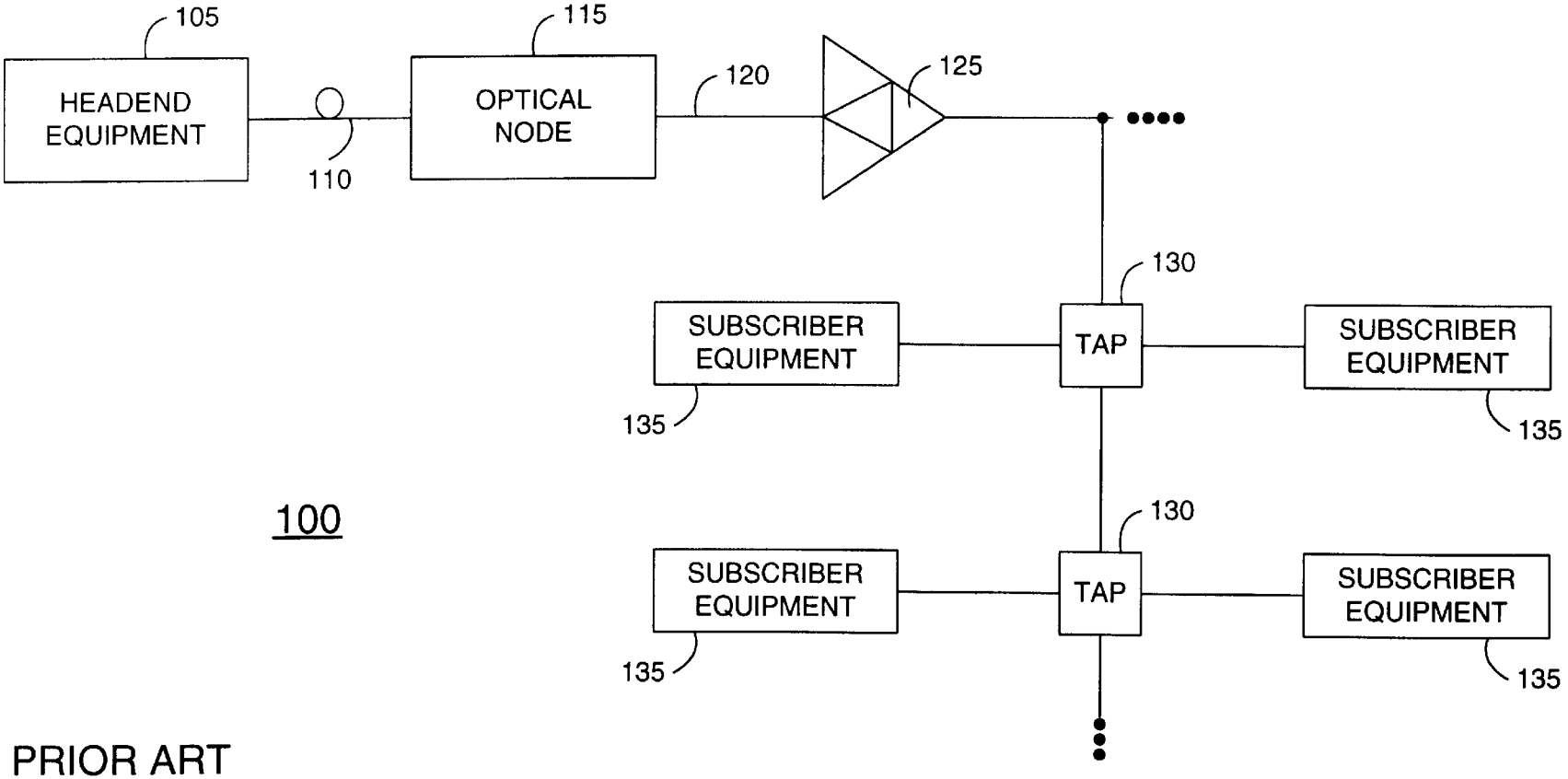
PRIOR ART FIG. 1
FIG. 1 is a block diagram of a conventional communication system, such as a cable television system.
Figure 2:
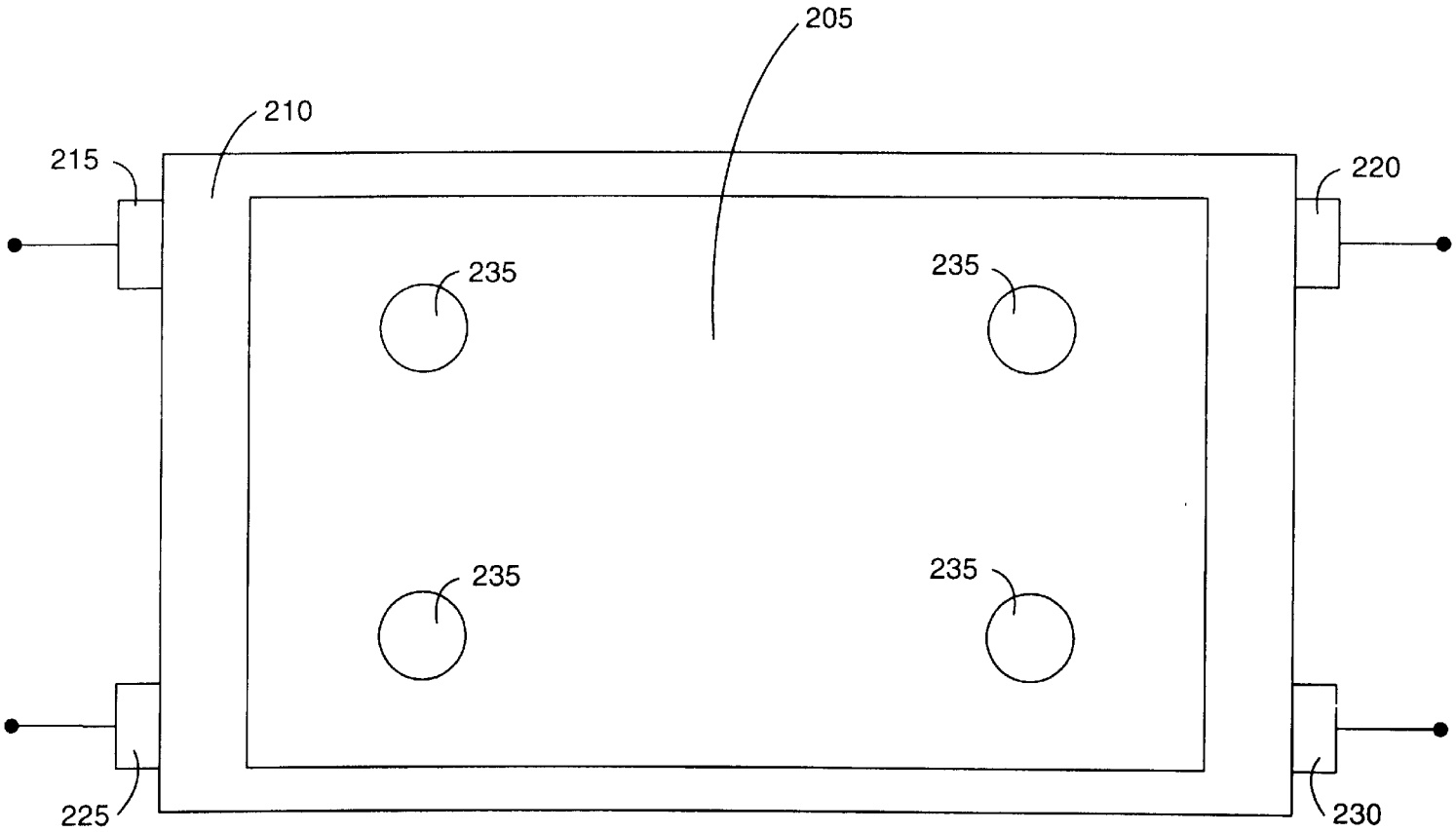
PRIOR ART FIG. 2
FIG. 2 is a diagram of a conventional amplifier included in the communication system of FIG. 1.

An electrically powered device, such as an amplifier 125, is depicted in FIG. 2. The amplifier 125 includes a module 205 contained within a housing 210. The amplifier 125 also includes an input port 215 for receiving RF signals from upstream and a primary output port 220 for transmitting those signals downstream to the next device in the communication system 100. There are also additional output ports 225, 230 that transmit RF signals to additional paths in the communication system 100. The input port 215 and output ports 220, 225, 230 of the amplifier 125 are also used in the reverse path to transmit reverse signals upstream and receive reverse signals from downstream. To activate or deactivate the additional output ports 225, 230, internal circuitry (not shown) is implemented within the module 205. This circuitry splits a predetermined portion of the RF signals and transmits them downstream through the output ports 220, 225, 230.

Also included in the module 205, and in the direct signal path of the input port 215 and output ports 220, 225, 230, are four sockets 235 in which to insert a power shunt. Where AC power is active on a coaxial cable, the power shunts are typically installed into the four sockets 235 after the module 205 has been seated into the amplifier housing 230 after it has been spliced onto the coaxial cable. This prevents the technician from "hot-plugging" the module 205 onto the coaxial cable during installation, which can allow current to pass through the module 205 before it is adequately seated into the housing 230, thereby causing damage to the components within the module 205. After the installation of the module 205 and the power shunts, however, there is nothing in the amplifier 125 that prevents excess current throughout the communication system 100 from damaging any of the internal components of the module 205. Therefore, protective devices can be installed in the amplifier 125 to protect the internal circuitry from failure due to power faults throughout the communication system 100.

One example of a protective device is a conventional fast-blow fuse. These fuses can be used in the amplifier 125, for example, by inserting them into the power shunt sockets 235, to prevent excess current from damaging the internal components of the module 205; however, once the conventional fast-blow fuse has blown, the amplifier 125 will be out of service until the fuse can be replaced. Correcting this type of device failure typically takes a great deal of time because the affected amplifier must be located, and the blown fuse must be replaced. As a result, there can be an extremely long delay in correcting the service outage to the subscriber. In addition, it will be appreciated that a blown fuse in an amplifier located first in a long cascade of amplifiers causes the service outage to affect substantially more subscribers than if the device failure occurred in the last amplifier in the cascade, and such outages magnify the severity of the problem.

An additional concern with the conventional fast-blow fuse is that the fuse can be blown due to a brief surge in current that causes a service outage. Immediately thereafter, the current may return to standard amperages. Since the fast-blow fuse has blown, however, the amplifier will not operate until the fast-blow fuse is replaced. Unlike conventional fast blow fuses, the amplifier 125 itself is often rated to withstand a current surge in excess of the standard operating currents for a predetermined period of time, such that if there is a brief excess current surge, the components within the module 205 will not be adversely affected. Thus, a blown fuse caused by an excess current surge results in an unnecessary service outage to the subscribers, if that current surge does not exceed the design and specifications of the amplifier 125. With the increased focus from the subscribers on the continuous service and reliability of the cable television and broadband systems, this type of service outage causes dissatisfied subscribers and, as a result, dissatisfied system operators.

Figure 3:
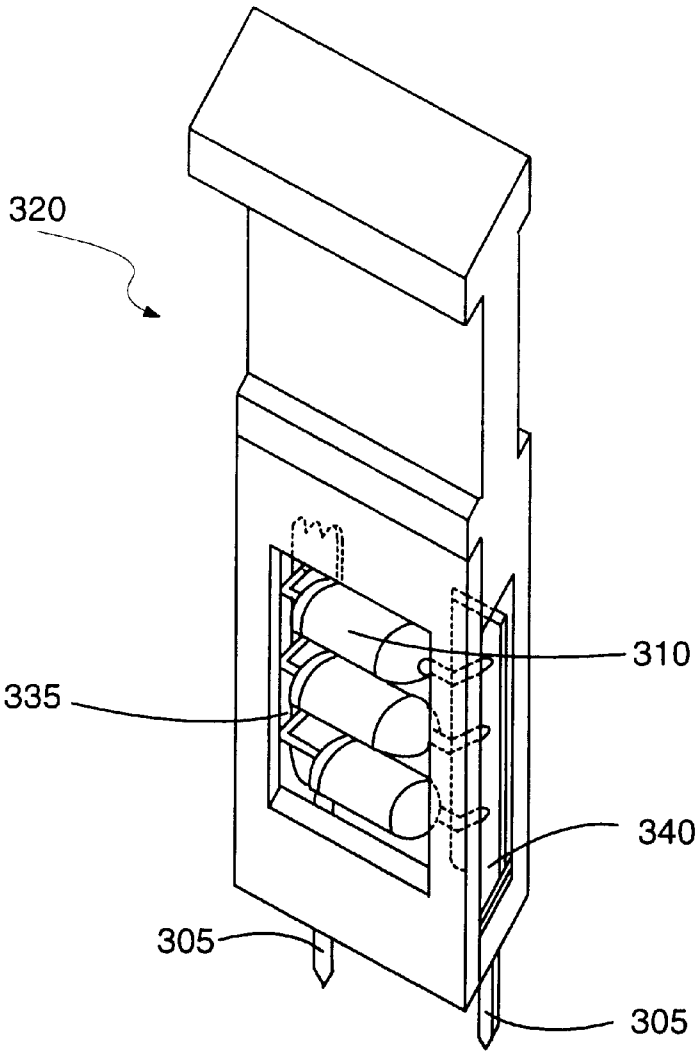
FIG. 3 is a diagram of a time delay fuse that can be implemented in the conventional amplifier of FIG. 2 in accordance with the present invention.

In accordance with the present invention, a time delay fuse assembly 300 is depicted in FIG. 3. The time delay fuse 300 can be installed into a conventional amplifier 125 in at least one of the four sockets 235 to replace one or more of the conventional power shunts and the conventional fast-blow fuses. The time delay fuse 300 can also be used in any other application requiring a time delay fuse so long as the terminating ends of the time delay fuse 300 and the corresponding sockets of the communication device are compatible. A primary advantage of the time delay fuse assembly 300 is that it protects the components of the module 205 from excess current supplied over a period of time, while also preventing the unnecessary outages that are experienced due to fast-blow fuses that are blown as a result of brief excess current surges. It will also be appreciated that the time delay fuse assembly 300 can be easily, conveniently and inexpensively installed into the module 205 of the amplifier 125 and into other electronic devices having appropriate connector sockets.

Conventional time delay fuses are not used in amplifiers 125 due to the current ratings that are required, e.g., 15A, 8A, and 4A, and the heat that is generated by both the amplifier 125 and the conventional time delay fuse. The generated high temperature can cause the fuses to blow well before the required Underwriter's Laboratory (UL) specifications. UL standard 248-14 states that a time delay fuse must meet all of the following separate and distinct specifications:

- 110% of the current rating must pass through the time delay fuse for a minimum of 4 hours;
- 135% of the current rating must pass through the time delay fuse for a maximum of 60 minutes; and
- 200% of the current rating must pass through the time delay fuse for a maximum of 2 minutes.

Another consideration is that the available space for protective devices in the conventional amplifier 125 is limited in width and height. As a result, the subminiature package requirement further prohibits adequate heat dissipation in the higher current rating time delay fuses. Subsequently, the time delay fuse will blow prematurely or the plastic will melt damaging the protective device 300 and the amplifier 125. For example, a lower current-rated conventional time delay fuse that generates less heat due to a lower resistance may be used in an amplifier 125 without failure if the footprint is compatible with the electrical device. On the other hand, a higher current-rated time delay fuse, such as a 15A or greater time delay fuse, however, will fail before the UL standards are met. As a result of the required subminiature package and higher current ratings, the heat dissipation is harder to accomplish with a conventional time delay fuse.

In accordance with the present invention, a subminiature time delay fuse assembly, designed to fit within the confines of the amplifier housing 210, has been tested and rated, after installation, to meet or exceed the UL 248-14 specifications. The fuse in accordance with this embodiment overcomes the problem with heat dissipation at the higher current ratings and provides advantages over conventional fast-blow fuses and conventional time delay fuses.

Figure 4:
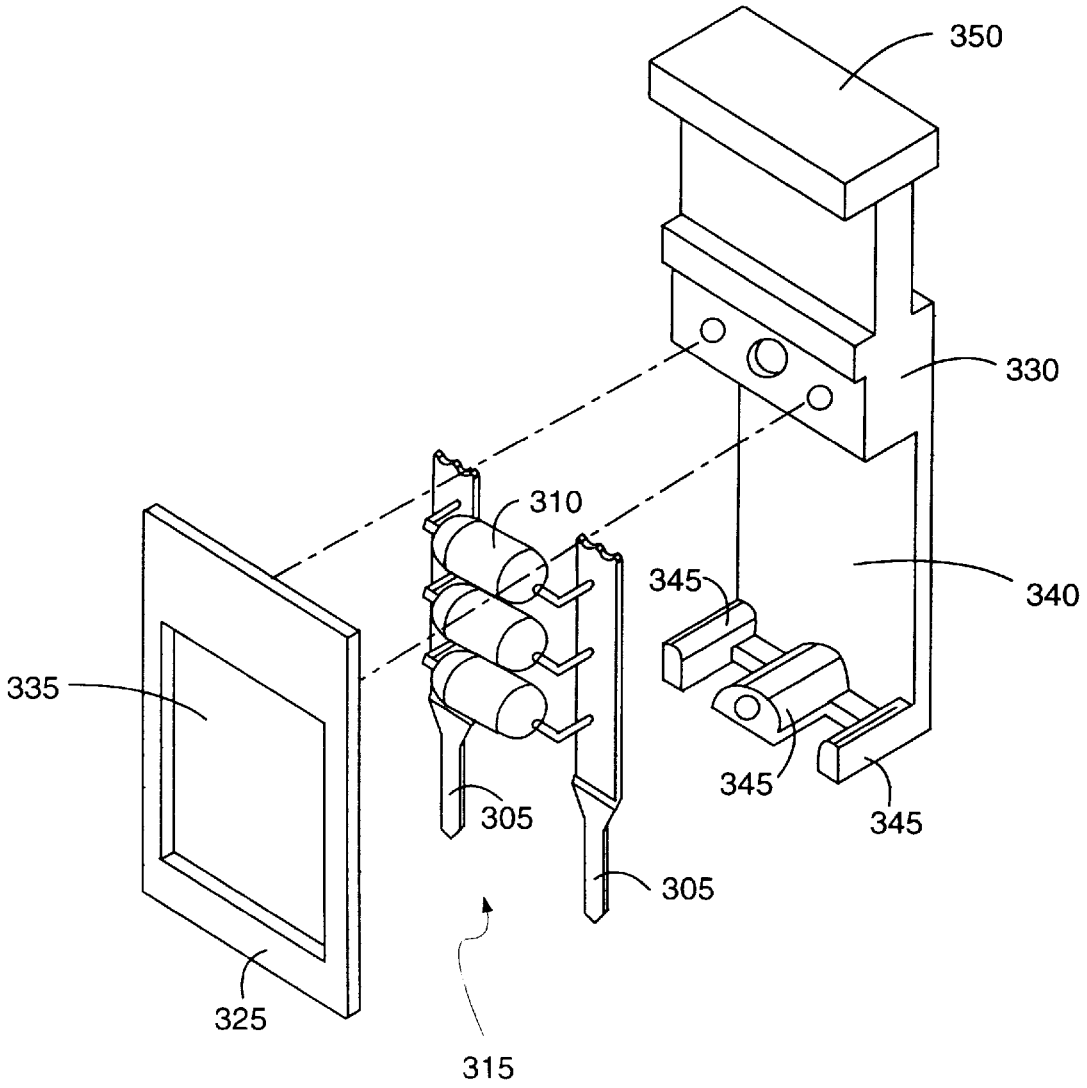
FIG. 4 is a diagram of the components depicting the assembly of the time delay fuse of FIG. 3 in accordance with the present invention.

Referring to FIG. 3 in conjunction with FIG. 4, the time delay fuse 300 includes two conductive terminals 305. The conductive terminals 305 can, for instance, be made from a metal such as beryllium copper. Through-holes are located on the upper ends of the conductive terminals 305 to accommodate leaded components. The lower ends of the conductive terminals 305 are formed for insertion into corresponding sockets of a printed circuit board of an electrical device, such as the module 205 in amplifier 125. The conductive terminals 305 are designed, stamped, and formed to conduct the rated current of the time delay fuse 300, while, in addition, minimizing the heat that is generated by the inherent resistance of the protective device 300. It will be appreciated that the dimensions and material used for the conductive terminals 305 are not design specific so long as they meet the requirement of the current rating while absorbing and moving the heat that is generated.

A minimum of one time delay fuse 310, such as a Littelfuse Slo-Blo type fuse, is soldered or otherwise electrically coupled into the corresponding through-holes of the conductive terminals 305, forming a fuse subassembly 315. Fuses 310 can be combined in parallel on the conductive terminals 305, as shown in FIGS. 3 and 4, to meet the specifications of the required current protection level. By way of example, three 5A time delay fuses 310 are combined in parallel for an assembled 15A time delay fuse assembly 300. Additional combinations can be accomplished by changing the quantity of fuses and their current ratings.

Referring to FIG. 3, a plastic housing 320 encapsulates the fuse subassembly 315 (FIG. 4). The plastic housing 320 is molded from a high-temperature plastic that is capable of withstanding the heat generated within the device into which the fuse 300 is inserted. A minimum temperature of 480 degrees Fahrenheit, for example, may be required, and this requirement may be met by using a high temperature plastic such as that manufactured by General Electric, Inc. under the name of DR 48. Referring to FIG. 4, the plastic housing 320 includes a front cover 325 and a back cover 330. There is a plurality of open-air vent holes formed at various locations on the plastic housing 320 for dissipating the heat that is generated from a higher current rated time delay fuse 300. As a result, the fuse 300 of the present invention, unlike conventional fuses, dissipates sufficient heat to prevent premature blowing of the fuse 300 or melting of the plastic housing 320.

More specifically, the front cover 325 has an open-air vent 335 that exposes the fuse subassembly 315 encapsulated within the housing 320. The open-air vent 335 on the front cover 325 allows the heat that is generated to dissipate through the open-air vent 335 and into the fuse surroundings. It will be appreciated that the open-air vent 335 can be designed as several different variations, e.g., with a plurality of vented fins or a lattice-type formation of apertures, to decrease the visibility of the fuse subassembly 315 while still maintaining the functionality of heat dissipation. The fuse 300 includes additional open-air vents 340 that are aligned with the fuse subassembly 315 on both sides of the plastic housing 300. These side-located vents 340 are defined by the cutout of the back cover 330 in combination with the front cover 325. These open-air gaps 340 further increase the heat dissipation away from the protective device 300.

Referring to FIG. 4, the back cover 330 of the plastic housing 320 is molded to include notches 345, which when assembled with the fuse subassembly 315 and the front cover 325, permit the lower portions of the conductive terminals 305 to extend through the housing 320 for insertion into mating sockets of an electrical device, such as the sockets 235 in amplifier 125. The back cover 330 can also include a molded end cap 350 formed on the opposing end of the notches 345. The end cap 350 functions as an insertion and removal aid for the technician at the time of installation.

FIG. 4 shows the assembly of the components included in the time delay fuse assembly 300 in accordance with the present invention. The fuses 310, of which the number and current values are chosen depending on the required specifications, are soldered into the corresponding through-holes of each conductive terminal 305 or otherwise electrically coupled to the terminals 305. The fuse subassembly 315 is then mounted, such as by a press-fit, into the back cover 330, and the front cover 325 is then secured to the back cover 330. The front cover 325 may be sonic-welded to the back cover 330, for example.

Functionally, the time delay fuse assembly 300 can be inserted into a port, i.e., the input port 215 or one of the output ports 220, 225, 230, to provide adequate protection from excess current flow, or a fuse 300 can be inserted into several or all ports for increased protection. Typically, a fuse is inserted into one port, i.e., the input port 215 or one of the output ports 220, 225, 230, determined to be the "power" port that is coupled along a common path closest to a power supply located on the coaxial cable. It will be appreciated that an amplifier coupled to a power supply in close proximity requires more fusing protection than an amplifier that is located further away, since to the voltage on the line drops through each progressive amplifier. By way of example, the first amplifier next to a power supply may require a 15A time delay fuse. The next amplifier in cascade may require an 8A time delay fuse, and similarly, the next amplifier following in cascade may require a 4A time delay fuse. In the 15A example, the 15A time delay fuse is rated for a maximum continuous current of 15A. If the current exceeds the 15A standard, the time delay fuse will exhibit the delay characteristics set forth in the UL standard. More specifically, the time delay fuse will continue to function for at least 4 hours with a current flow of 16.5A. If the current increases to 20.25A, the time delay fuse is rated to withstand this current for 60 minutes maximum, and similarly, if the current increases to 30A, the time delay fuse will operate for 2 minutes maximum before blowing.

The time delay characteristic allows the amplifier 125 to continue functioning under normal operating procedures with increased current conditions that are within the specifications of the time delay fuse assembly 300 until such time as the current returns to the standard 15A. Thus, one advantage of using the time delay fuse assembly 300 instead of a conventional fast-blow fuse is the avoidance of unnecessary outages due to brief surges of excess current that soon thereafter return to normal. This decreases the cable television operator's repair and maintenance time and saves them substantial maintenance costs. On the other hand, if the current exceeds the specifications of the time delay fuse 300 or does not return to the standard 15A within the rated time frame, the time delay fuse 300 will blow to protect the components of the module 205. A cable television operator is then able to determine the fault location in the communication system 100 and, after fixing the root problem, replace the time delay fuse 300 in the amplifier 125 without having to replace any damaged amplifier components.

In summary, the time delay fuse 300 in accordance with the present invention is a subminiature protective device designed to withstand a higher current rating of 15A and dissipate heat without failure. The time delay fuse can easily be installed into a module 205 of an existing amplifier 125 to protect the amplifier 125 from excess or prolonged current surges. The time delay fuse assembly 300 allows a cable television operator to fuse a network, according to its powering design, to maximize the protection to the subscribers throughout the communication system 100. These protective devices 300 minimize unnecessary service outages, the number of subscribers that may be affected by a service outage, and the costs of maintenance. In addition to the functionality advantages, they are economical, convenient, and easily installed in electrical devices, such as cable television distribution amplifiers.

What is claimed is:

1. A subminiature time delay fuse device having at least one time delay fuse for receiving a power signal and providing an open circuit when the power signal is determined to be excessive, the improvement comprising:

a housing having a plurality of vent holes formed therein, wherein the housing partially encloses the at least one time delay fuse, and wherein heat is dissipated through the plurality of vent holes, the housing comprising:

a front cover with at least one open-air vent; and a back cover comprising:

an end cap formed at a top end of the back cover; and notches formed on a bottom end of the back cover; and side vents defined by openings formed between the front cover and the back cover when the front cover and the back cover are assembled to form the housing; and two conductive terminals having an amount of metal sufficient to dissipate heat generated by the subminiature time delay fuse device, each of the conductive terminals having an upper end and a lower end, wherein the lower ends extend from the notches in the housing, and wherein the at least one time delay fuse is mounted to the upper ends within the housing, and wherein the at least one time delay fuse forms a fuse subassembly when mounted onto the upper ends of the conductive terminals and the fuse subassembly is aligned with the side vents.

2. The subminiature time delay fuse device of claim 1, wherein the housing is made from a high temperature plastic that is capable of withstanding a minimum temperature of 480 degrees Fahrenheit.

3. An electronic device for processing signals, the electronic device comprising:

an input port for receiving the signals, wherein the signals comprise a data signal and a power signal;

an output port for transmitting the data signal;

electrical circuitry coupled between the input port and the output port for processing the data signal; and a time delay fuse device electrically coupled to the input port to receive the power signal, the time delay fuse device comprising:

a fuse for receiving the power signal and for providing an open circuit to prevent transmission of the power signal to components of the electrical circuitry when the power signal is determined to be excessive for a predetermined period of time;

a housing having a plurality of vent holes formed therein, wherein the housing partially encloses the fuse, the housing comprising:

a front cover with at least one open-air vent; and a back cover comprising:

an end cap formed on a top end of the back cover for providing an insertion aid and a removal aid for the time delay fuse device; and notches formed on a bottom end of the back cover; and side vents defined by openings formed between the front cover and the back cover when the front cover and the back cover are assembled to form the housing; and two conductive terminals, each having an upper end and a lower end, wherein the fuse is electrically coupled between the upper ends, and wherein the lower ends extend from the notches in the housing to transmit power signals that are not excessive and, when the power signal is determined to be excessive for the predetermined period of time, to provide the open circuit therebetween.

4. The electronic device of claim 3, wherein the electronic device comprises an amplifier.

5. The amplifier of claim 4, wherein the fuse, having characteristics of a slow blow fuse, forms a fuse subassembly when mounted onto the upper ends of the conductive terminals.

* * * * *